United States Patent [19]

Weber-Henning

[11] 4,456,285

[45] Jun. 26, 1984

[54] LONGITUDINALLY ADJUSTABLE SKI POLE

[76] Inventor: Hans Weber-Henning, Dorfhalde 14, 8712 Stäfa, Switzerland

[21] Appl. No.: 346,745

[22] Filed: Feb. 8, 1982

[30] Foreign Application Priority Data

Feb. 19, 1981 [CH] Switzerland ..... 1121/81

[51] Int. Cl.[3] ..... A63C 11/22

[52] U.S. Cl. ..... 280/823; 135/75; 403/109

[58] Field of Search ..... 280/819, 823; 135/75; 403/326, 109; 248/188.5

[56] References Cited

U.S. PATENT DOCUMENTS

| | | | |
|---|---|---|---|
| 886,078 | 4/1908 | Rugg | 280/823 X |
| 2,245,993 | 6/1941 | McCoy | 403/109 X |
| 3,456,662 | 7/1969 | Weber | 403/109 X |
| 3,987,807 | 10/1976 | Varnell | 403/109 X |

FOREIGN PATENT DOCUMENTS

| | | | |
|---|---|---|---|
| 148561 | 2/1937 | Austria | 280/823 |
| 73712 | 7/1943 | Norway . | |

*Primary Examiner*—Joseph F. Peters, Jr.
*Assistant Examiner*—Michael Mar
*Attorney, Agent, or Firm*—Warren B. Kice

[57] ABSTRACT

A longitudinally adjustable ski pole is provided with two tube sections arranged telescopically movable into each other and are provided with a latch and several catches. When shortening the ski pole a spring is tensioned. An extending of the ski pole in longitudinal direction is caused by the tensioned spring. The switching element is arranged, for instance, at the rear side of the hand grip of the ski pole. The latch is supported at the outer of the tubes and the catches are located at the inner of the two tubes. The catches are formed as a through hole through the tube and comprise a supporting shoulder provided with a supporting face. The latch is arranged at a tilting lever which is spring biased and operationally connected to a switching member. The entire mechanism for the longitudinal adjustment of the ski pole is arranged in the grip section of the ski pole. This grip section can quite easily be mounted to the common ski pole tubes. The ski pole is intended specifically for cross-country skiers who can adjust the pole during the skiing proper to three various lengths whereby a chosen length is arrested by a form closed locking of the two tubes telescopically inserted into each other. The latch may be brought by means of the switching member into an intermediate position, in which it does not engage into any one of the catches such that no locking of the two tubes is present such that an elastically yielding ski pole is provided.

16 Claims, 5 Drawing Figures

LONGITUDINALLY ADJUSTABLE SKI POLE

BACKGROUND OF THE INVENTION

1. Field of the Invention

The present invention relates to a longitudinally adjustable ski pole provided with two tube sections arranged telescopically movable into each other; provided further with an arresting means for fixedly arresting said tube sections in their respective positions; an operating member located at the handle grip of said ski pole and intended for making and breaking the fixation of said tube sections relative to each other, which operating member is located at the ski pole within reach of the fingers of the skier's hand gripping the ski pole; which said arresting means comprises a latching means having a plurality of catches; a spring member which engages at the one end the inner of said two telescopically arranged tube sections and at the other end the outer of said two telescopically arranged tube sections, which said spring member tends to bias said two tube sections away from each other.

Such ski pole may be utilized at the one hand as rigid ski pole having an adjustable length and at the other hand as an elastically yielding ski pole. This is of a specific interest at a ski pole for cross-country skiing because this allows that at the one hand the longitudinal extent of the ski pole may be adjusted in accordance with the country shape and at the other hand it is possible to utilize the spring force stored in the stock as a thrusting aid.

2. Description of the Prior Art

Such a ski pole is disclosed in the NO-PS No. 73 712. The latching means of this known ski pole (FIG. 4) consists of elastically radially spreadable tongues which are operated by an operating member via an axially extending rod. The catches for the latch consist of circumferentially extending grooves. The operating member has the form of a push button. If the push button is in its not-depressed position, both tube sections are locked to each other and there is provided a rigid ski pole having a given, chosen length. By continuously depressing the push button, the locking or arresting of the two tube sections is terminated, i.e. they are in an unlocked condition and a spring elastic ski pole is provided. The drawback of this ski pole is that when using the ski pole as a spring elastically yielding cross-country ski pole, the push button must continuously be kept depressed in order to utilize the stored spring force as thrusting aid. A further drawback is the fact that when adjusting the length of the rigid ski pole the latch cannot positively snap into predetermined, for instance, two or three catches for the latch when the ski pole has attained during the skiing, i.e. during its placing onto the ground, i.e. the snow has attained the sought length. The adjusting of the pole from its elastically yielding condition to its rigid condition and vice versa as well as the increasing or decreasing the length of the rigid ski pole should be carried out during the skiing proper without any detrimental influence of the skier's rhythm.

SUMMARY OF THE INVENTION

Hence, it is a general object of the present invention to provide an improved construction of a longitudinally adjustable ski pole which does not suffer under above mentioned drawbacks.

Another object of this invention aims at the provision of a new and improved construction of a longitudinally adjustable ski pole which is extremely simple in construction and design, reliable in operation, economical to manufacture and dependable in use.

A further object of the invention is to provide an improved longitudinally adjustable ski pole which allows a changing of its length without detrimentally influencing the skier's rhythm during cross-country skiing.

A further object is to provide a ski pole which may be brought in an elastically yielding position without the need to continuously exert a force by the skier's finger.

Now, in order to implement these and still further objects of the invention, which will become more readily apparent as the description proceeds, the longitudinally adjustable ski pole of this development is manifested by the features of comprising a double arm tilting lever at which the latching means is arranged, which said tilting lever is supported in said outer tube section, which said outer tube section carries the grip of said ski pole and which tilting lever is spring biassed; whereby said latching means is arranged at one arm of the double arm tilting lever and the other arm of said double arm tilting lever is engaged by said operating member.

BRIEF DESCRIPTION OF THE DRAWINGS

The present invention will be more fully understood by reference to the following detailed description thereof, when read in conjunction with the attached drawings, and wherein.

DETAILED DESCRIPTION OF THE PREFERRED EMBODIMENTS

Figure 1:
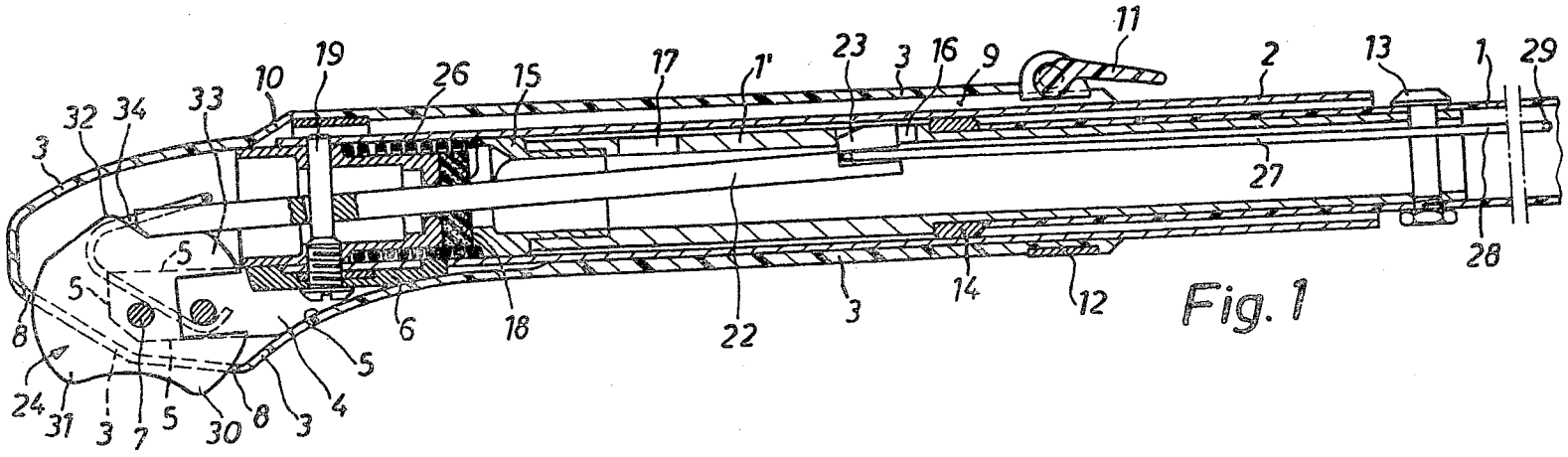
FIG. 1 is a view of a section through an upper part of a ski pole, which part encompasses the ski pole handle grip whereby the operating member is shown in a first position.
Figure 2:
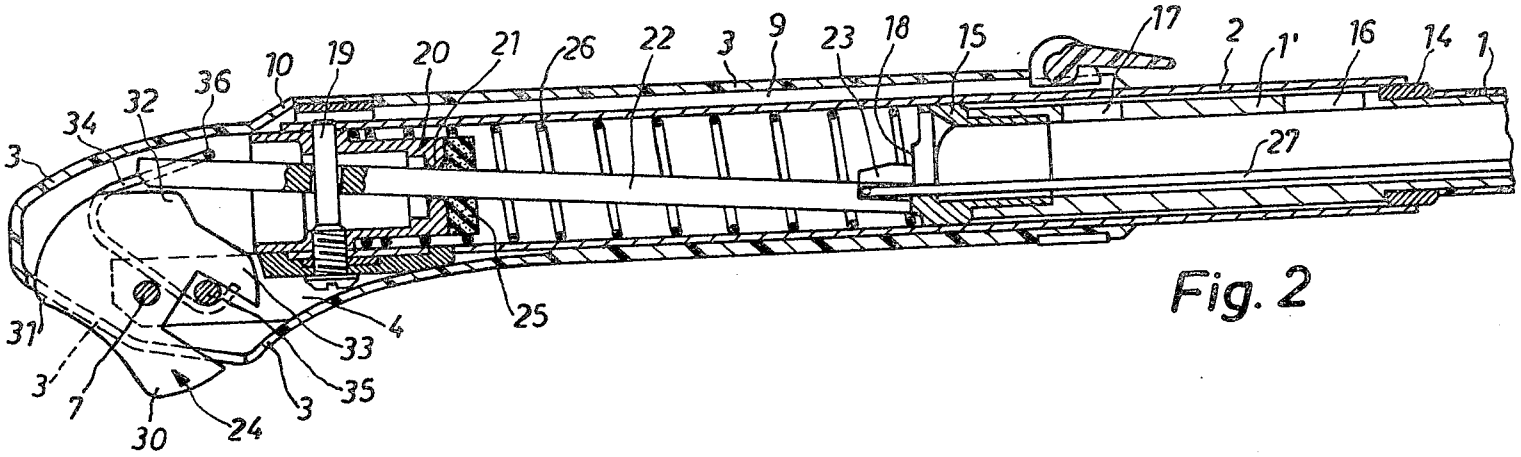
FIG. 2 is a view similar to the view of FIG. 1 whereby, however, the operating member is in a second position.

Describing now the drawings and condering initially the exemplary embodiment of the ski pole as shown in FIGS. 1 and 2, it will be understood that same comprises an inner tube section 1 which carries at its lower not particularly shown end the well-known snow disk as well as the ski pole point. There is provided, furthermore, a further, outer tube section 2 which is somewhat, but only a little, longer than the ski pole handle grip. The ski pole handle grip comprises a shell 3 manufactured of a plastics material, which shell 3 is in the practice a multi-part structural element which is, however, drawn in the figures as an integral onepiece element due to clarity reasons. This plastics material shell of cross-country ski poles carries usually preferably a covering made of deerskin or rawhide, respectively, which rawhide, however, is also not particularly shown. The outer tube section 2 is provided with a fitting 4 having an outer shape following the contour line 5 as shown in mentioned figures. This fitting 4 comprises a sectional surface 6. This fitting 4 shows in a top view onto the ski pole a U-shaped form, of which both free legs are arranged in the figures at the left side, which two legs extend parallel to the plane defined by the surface of the drawing sheet. Both these legs are provided each with a bearing bore for receiving a bearing pivot 7. The bearing shell 3 comprises a slit-like through hole 8, whereby a not shown sealing ring is mounted to its open end.

A clamping eccentric 11 is arranged at the lower end of the ski pole grip, which clamping eccentric 11 is supported in a clamping ring 12. The screw bolt arrangement with which the clamping ring 12 is tensioned serves simultaneously as a support of the clamping eccentric 11. It has been mentioned above that the gripping shell 3 is covered by, for instance, rawhide. This rawhide or deerskin, respectively, may be pressed by the agency of the clamping ring 12 against mentioned gripping shell 3 such that a clean and safe end portion of this rawhide cover is arrived at at its lower end. The clamping eccentric 11 serves for clamping the not shown two ends of the ski pole loop, which ends are those of the well-known loop through which the skier extends his hand and wrist when gripping the ski pole. This loop is of a well-known design used at any ski pole and thus it is not described in detail. The two mentioned loop end sections extend inside a longitudinal channel 9 which is located between shell 3 and the outer tube section 2. Accordingly, the loop extends at a penetration hole 10 out of the grip.

Below a first embodiment of the resting or locking, respectively, means of the ski pole is explained based on FIGS. 1 and 2, with which arresting means the two telescopically arranged ski poles which may be moved into each other may be arrested in their respective positions whereby the arresting means may be unlocked again at a later occasion for unlocking the two tubes. The inner tube section 2 which carries the ski pole point as well as the snow disk is mounted by means of a screw bolt 13 onto a tubelike grip insert 1'. This grip insert 1' and the outer tube section 2 are made of a light metal and are shaped with such a cross-sectional shape not particularly shown that they define together a key and keyway arrangement for rotationally arresting two mentioned elements relative to each other. A bearing bush 14 made from a plastics material or from brass is guided axially movable in the outer tube section 2 such that the inner tube section 1, 1' is fixed against the rotation within the outer tube section 2. A further bearing bush 15 made of brass or of a plastics material is fixedly inserted into the grip insert 1'. The above mentioned structural members 1, 1', 14 and 15 are accordingly fixedly mounted to each other and carry at the not shown, in the figures at the right hand located end the ski pole point as well as the snow disk. The inner tube section 1, 1' of the embodiment shown in FIGS. 1 and 2 is provided with three catches 16, 17 and 18 for a latch. The two catches 16 and 17 are shaped as a through hole extending through the inner tube section 1, 1' and the catch 18 is designed as a bearing shoulder having a bearing face located at the bearing bush 15 and accordingly at the inner tube section 1, 1'. FIG. 2 discloses clearly that this bearing or supporting, respectively, shoulder 18 is located eccentrically relative to the longitudinal center line of the structural members 1, 1' and 15. Viewed in the longitudinal direction of the inner tube section 1, the catches 16, 17 and 18 are located sequentially behind each other, however at both sides of above mentioned longitudinal center line. In the embodiment catch 17 may be a circular bore and catch 16 is constructed as an elongated hole having the same width as the diameter of the catch 17.

The fitting 4 which carries the bearing pivot 7 is mounted by the agency of a screw bolt 19 to the outer tube section 2. By means of mentioned screw bolt 19 additionally a bush 20 is held in the outer tube section 2. This bush 20 is provided with a bearing area 21 for a double armed tilting lever 22. A latch 23 is mounted to one arm of this double armed tilting lever and the other arm thereof engages into an operating member 24. The tilting lever 22 is supported via a screw bolt 19 at the outer tube section 2 and may be moved or tilted into the two tilted end positions shown in FIGS. 1 and 2 as well as an intermediate position located between the two end positions which is not shown in FIGS. 1 and 2 in which intermediate position the tilting lever 22 extends parallel to the longitudinal center or axis of the outer tube section 2. Furthermore, a rubber pad 25 is located at the face end of bush 20, which rubber pad 25 may be, for instance, made of a rubber sponge in which, as is well known, air bubbles are enclosed in numerous cells. The supporting shoulder 18 which is mounted to the inner tube section 1 may abut this rubber pad 25 (FIG. 1). Inside the outer tube section 2 a spiral pressure spring 26 is located, which spiral pressure spring 26 abuts at one end bearing bush 15 and at the other end the inner tube section 1. This spiral pressure spring tends to press the two tube sections 1 and 2 axially away from each other, to urge these two tube sections 1 and 2 away from each other, whereby the end position shown in FIG. 2 is arrived at, in which end position the ski pole is in its longest state. Also in this state of the ski pole the spring 26 is in a biassed position. The compressed position of spring 26 is shown in FIG. 1, in which position also the other end position of the ski pole, namely its state of shortest length, is shown. In order to limit the decompression or relieving, respectively, of the spring 26 and accordingly in order to limit the longest attainable length of the ski pole, use is made of a wire loop 27 pivotably connected to the tilting lever 22, which wire loop 27 is bent in its free end section 28 in shape of a hairpin such that this wire loop 27 surrounds at its section 28 at both sides screw bolt 13. Accordingly, spring 26 can be relaxed only so much until the end 29 of the loop 27 abuts screw bolt 13. By means of the end positions of the pressure spring 26 shown in FIGS. 1 and 2 a practical embodiment of the ski pole allowed an adjusting of the ski pole length by 70 mm. In the longest position of the ski pole shown in FIG. 2 latch 23 abuts the supporting shoulder 18 of bearing bush 15. In the shortest position of the ski pole such as shown in FIG. 1 the latch 23 engages into catch 16.

The operating member 24 for the tilting lever 22 is shaped as a cam plate which can rotate around the bearing pivot 7 whereby its axis of rotation, namely the longitudinal center or axis of a bearing pivot 7 extends perpendicularly to the longitudinal center or axis of the ski pole. This cam plate 24 is provided with four cams 30, 31, 32 and 33. As clearly shown in FIG. 2, cam 30 projects considerably beyond the outer side of the rigid gripping shell of the ski pole. In this rotational position of cam plate 24, cam 31 could end about flush with the handle shell 3 in accordance with a practical embodiment. In the shown embodiment cam 33 projects outwardly by only a small margin beyond shell 3. In FIG. 2 one of the rotational end positions of the operating member 24 is shown whereby in FIG. 3 the opposite rotational end position of the operating member 24 is shown in which cam 31 projects considerably outside of shell 3. In this position of the operating member 24 in a practical execution cam 30 could be again about flush regarding shell 3. In FIG. 1 an intermediate position of the operating member 24 is shown, in which position both cams 30 and 31 extend considerably beyond shell 3 of the handle grip. Because it already was mentioned further above that the loop arranged at the handle grip of the ski pole extends outwards through a penetration hole 10, i.e. is located in the drawings above the ski pole grip whereby this loop faces the body of the cross-country skier, it is obvious, that the operating member 24 is located oppositely to the loop and, therefore, at the rear side of the ski pole grip. The cam plate, i.e. operating member 24, is thereby arranged and located such at the upper area of the ski pole grip that it is located within reach of the index finger of the skier's hand gripping the ski pole. Both cams 30, 31 are accordingly intended to be pressed by the cross-country skier into the ski pole grip. The other two cams 32 and 33 are located always inside of the ski pole grip.

The tilting lever 22 is influenced by a tilting lever spring 34, of which one end is supported via a pin 35 on fitting 4. The other end 36 of this spring abuts one arm of the double armed tilting lever 22. The spring 34 urges tilting lever 22 in the end position shown in FIG. 1. The operating member 24 is operationally connected via cams 32 and 33 with the tilting lever 22 and accordingly to latch 23 such to move latch 23 into the engagement or out of engagement with one of the catches 16, 17 or 18. In the end position shown in FIG. 1 this tilting lever spring 34 is still prestressed, biassed.

In the end position of the operating member 24 shown in FIG. 2 (cam 31 is pressed to the inside of the ski pole handle) the tilting lever 22 is lockingly held by cam 32 against the force of the tilting lever spring 34 in the end position as shown in FIG. 2. This locking or arresting, respectively, is produced in that the force exerted by the end 36 of the spring onto tilting lever 22 produces in FIG. 2 a clockwise directed momentum around bearing pivot 7. In this arrested or locked, respectively, end position of the operating member 24 latch 23 is held in the catch formed as supporting shoulder 18 such as to keep the ski pole locked in its longest condition. The two telescopically arranged tube sections 1 and 2 which can be moved into each other are in this arrested position located furthest away from each. This catch 18 is located closest to the operating member 24.

If the operating member 24 is in its intermediate position such as shown in FIG. 1 (both cams 30 and 31 are located outside of the unmovable grip shell 3), the tilting lever 22 is in a position intermediate of the two cams 32 and 33. In this position of the tilting lever 22 it engages through the tilting lever spring 34 by means of latch 23 into catch 16. In this position the two tube sections 1 and 2 are moved furthest into each other such that in such condition the ski pole is in its shortest state.

Figure 3:
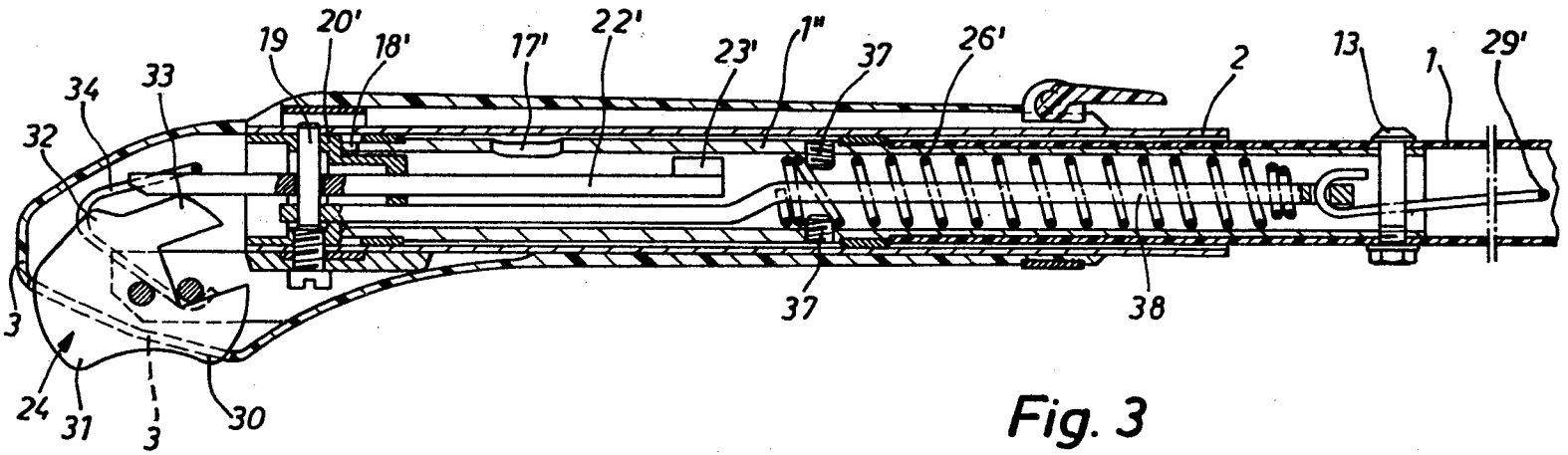
FIG. 3 shows a second embodiment of the ski pole in accordance with the invention at the view similar to the views of FIGS. 1 and 2 whereby the operating member is shown in a third switching position.

If the operating member 24 according to the embodiment of FIGS. 1 and 2 is pressed in the other end position shown in FIG. 3 such, that also cam 30 is located within the fixed handle grip shell 3, the tilting lever 22 is urged by cam 33 against the force of the tilting lever spring 34 in a position in which it extends substantially parallel to the longitudinal center or axis of the ski pole such that latch 23 is out of engagement with catch 16 and accordingly is not in contact with structural member 1'. Now, the two tube sections 1 and 2 are no longer locked or arrested, respectively, to each other and both tube sections 1 and 2 will be spring elastically yielding pushed into each other.

Below the operation of the embodiment shown in FIGS. 1 and 2 will be now described whereby due to the third position of the operating member 24 shown in FIG. 3 reference will be made to FIG. 3 only inasmuch as it is necessary for understanding the mode of operation of the embodiment shown in FIGS. 1 and 2. At the state of the ski pole as shown in FIG. 1 the two tube sections 1 and 2 are telescoped furthest into each other such that the ski pole is in its shortest length. Thereby, spring 26 is compressed to the largest extent. This shortest length of the ski pole is maintained because latch 23 engages catch 16 and accordingly the two tube sections 1 and 2 are locked to each other. The operating member 24 is in its intermediate position. This position is kept due to the action of the tilting lever spring 34. The ski pole shown in FIGS. 1 and 2 can be adjusted into three states of longitudinal extent, namely "short", "normal (intermediate)" or "long". In order to proceed from the position or state "short" shown in FIG. 1 to state "intermediate" cam 30 of the operating member 24 is pushed inwards by the skier during a short period of time such as is shown in FIG. 3. Accordingly, the skier gives here only a short impulse but does not leave his index finger lying on the cam 30. Due to this short impulse latch 23 is moved out of catch 16 such that the pressure spring 26 can release itself somewhat. The latch 23 which is acted upon by tilting lever spring 34 shifts along the wall of the structural member 1' and snaps into the catch 17. Now, the ski pole is in its intermediate position. If now the ski pole is to be adjusted to its longest state, cam 31 of the operating member 24 is pushed inwards such as shown in FIG. 2. Accordingly, latch 23 disengages from catch 17 and is kept locked in the position shown in FIG. 2. Now, the ski pole is in its longest state. This elongation of the ski pole is accordingly due to the force of spring 26. Conclusively, this spring may be made to be relatively a soft spring whereby the practical execution has shown that the force needed to compress spring 26 into the position shown in FIG. 1 should be about in the range from 2 to 4 pounds. This extending of the length of the ski pole can be carried out by the cross-country skier, for instance, when the ski pole is lifted off the ground and moved forwardly during skiing, i.e. before the ski pole is placed again onto the ground, onto the snow surface.

If the ski pole is in its state of longest length and it is intended to shorten same, the following procedure is to be followed. The operating member 24 is pressed at its lower end inwards, i.e. cam 30 will be pressed in accordance with FIG. 3 into within the handle grip such that the tilting lever 22 is held by cam 33 in a position parallel to the longitudinal axis of the ski pole. Thereafter the ski pole is urged via the inner tube section 1 against the ground and the cross-country skier presses the tube section 2 against the force of the spring 26 downwards. Latch 23 held in the center of the outer tube section 2 moves through the bearing bush 15 through within the structural member 1'. The operating member 24 is thereafter released such that due to the force of spring 34 it moves into its intermediate position shown in FIG. 1. Here, the latch 23 which is biassed by spring 34 snaps into catch 17. Should the skier desire to shorten the ski pole further, the same procedure is followed, i.e. cam 30 is again pressed inwards and simultaneously the tube section 2 is pushed downwards against the force exerted via spring 26, i.e. the ski pole is again supported against the ground. Accordingly, latch 23 arrives in catch 16. This extending of the length of the ski pole is initiated accordingly merely by giving an impulse, i.e. by a short pressing of cam 30 and continues automatically by the agency of spring 26. The shortening of the ski pole proceeds against the force of the spring 26 such that in order to shorten the ski pole it must be pushed against the ground. The above described ski pole can be adjusted to three lengths whereby every ski pole length is arrestable or lockable, respectively, and every locked position can be unlocked by operating the operating member 24.

Accordingly, the above described ski pole can be adjusted to have three lengths whereby in every state of chosen length the tube sections 1 and 2 are arrested, locked to each other such that a rigid ski pole is provided and not a spring elastically yielding ski pole is provided. This adjusting of the length of the ski pole can be quite advantageous for, for instance, a cross-country skier. If the countryside is rising, i.e. if the cross-country skier is skiing or walking, respectively, upwards, he can adjust his ski pole to have the shortest length and at a downhill stretch one would use the ski pole adjusted to its largest length. If the countryside is irregular, it is possible to use the ski pole in such case adjusted to its intermediate length whereby this so-called intermediate length is the normal length of the ski pole, a length which the cross-country skier would use in such cases if he would have a common ski pole which has no adjustable length. The ski pole which is adjustable to three lengths may, however, be also used for downhill skiing, such for instance for rented ski poles which are rented out, for instance, by a sport shop to various persons and such it is possible to adjust initially the length of the rented ski pole to the individual skier.

The described ski pole can, however, be made in accordance with the second embodiment shown in FIG. 3 such that in addition to the rigid, i.e. lockable, ski pole length a spring elastically yielding ski pole is provided, such that the ski pole is spring elastic between its shortest state and its longest state. The catches of this second embodiment are located exclusively on one side only relative to the longitudinal center axis of the ski pole. Only the two catches 17′ and 18′ are present. A tilting lever 22′ carries a latch 23′. If the latch 23′ has engaged the catch 17′, the ski pole is in the state of its normal length. If the latch 23′ engages catch 18′, the ski pole is in the state of its largest length. These two ski pole lengths or states, respectively, have been provided again by a locking or arresting, respectively, of the tube sections 1 and 2 such that the ski pole as such is a rigid ski pole. A tubelike structural member 1″ is again mounted via the screw bolt 13 to the inner tube section, which tubelike structural member is provided with the two catches 17′ and 18′. The embodiment according to FIG. 3 utilizes a spiral tension spring 26′ which accordingly is arranged between the two tube sections 1 and 2. One of the ends of spring 26′ is mounted via plug 37 to the structural member 1″ and is accordingly supported by the inner tube section 1. The other end of spring 26′ abuts against a thrusting rod 38, which is supported on screw bolt 19. Because this screw bolt 19 is mounted to the outer tube section 2, the above mentioned end of the spring is supported by the tube section 2. If accordingly the two tube sections 1 and 2 are pushed further into each other, this tension spring 26′ is tensioned. The position or state, respectively, of the ski pole as shown in FIG. 3 is no resting state because the pressure spring 26′ is tensioned to its maximal length whereby the structural member 1″ abuts the bearing bush 20′. Accordingly, in the position shown in FIG. 3 the inner tube section 1 is supported via its not shown ski pole point or via its snow disk against the ground or snow, respectively, and the cross-country skier pushes the outer tube section 2 against the force of spring 26′ maximally downwards. As soon as the force exerted by the cross-country skier disappears, the outer tube section 2 moves the spring elastically upwards (the ski pole shifts into its largest length), which upward movement of the outer tube section 2 proceeds until the end 29′ of the loop abuts the screw disk 13. A practical execution has shown, that the spring elastic distance, i.e. the extent in which the two tube sections move relative to each other, may amount to about 70 mm. If this spring elastic cross-country ski pole is used, it is intended to facilitate the skiing of the cross-country skier by this back spring action; a thrusting movement against the ground is to be made. In order to arrive at a substantial improvement in such case the tension spring 26′ should be harder, i.e. stronger, than the pressure spring used in the first embodiment. The practical execution has shown that spring 26′ comprises such a spring elasticity that the force of 4–30 pounds should be necessary in order to bring this spring 26′ into its maximally tensioned state in accordance with FIG. 3.

The mode of operation of the ski pole of the embodiment shown in FIG. 3 is as follows: If cam 30 according to FIG. 3 is pushed inwards to within the grip of the ski pole, a momentary impulse is given because the rotational position of the operating member 24 of FIG. 3 is not a stable state since the spring 34 tends to push the operating member 24 into a stable position in accordance with FIG. 1. Accordingly, as long as the cross-country skier pushes by means of his finger cam 30 inwards, the tilting lever 22′ will be kept in its intermediate position shown in FIG. 3 such that accordingly the latch 23′ will not abut the structural member 1″. The tensioned spring 26′ tends to increase the length of the ski pole. If the operating member 24 is released, latch 23′ will be urged and pressed against the structural member 1″ by the action of the tilting lever spring 34 and the ski pole will be lengthened until latch 23′ snaps into catch 17′. Now, the ski pole is in its state of normal length whereby the two tube sections 1 and 2 are rigidly locked to each other. If now the cross-country skier decides to have his ski pole in its longest state, he must continue to press cam 30 inwards according to FIG. 3 such to release spring 26′. Conclusively, latch 23′ reaches catch 18′. This means, that if the cross-country skier releases cam 30, the tilting lever spring 34 rotates the operating member 24 always into the intermediate position shown in FIG. 1 such that the latch 23′ when passing a catch will snap into the catch and will remain therein until again cam 30 or cam 31 of FIG. 2 will be pressed inwards. If cam 31 is pressed into the position as shown in FIG. 2, the operating member 24 is brought in a stable state such that also when releasing cam 31 the operating member 24 will remain in its position shown in FIG. 2 whereby the latch 23′ will remain in its state or position, respectively, shown in FIG. 3, i.e. it will not snap into any of the catches. Accordingly, this ski pole is now in its elastically yielding state.

A common feature of both above explained embodiments is accordingly that the operating member 24 is made with only two stable positions, namely those positions shown in FIGS. 1 and 2. The position of the operating member 24 shown in FIG. 3 will be maintained only as long as the cross-country skier presses by means of his finger cam 30 inwardly. As soon as the force exerted is released, the operating member 24 returns into its position shown in FIG. 1. The difference between these two embodiments is, however, the position of the latch 23' after the operating member 24 has been pressed into the stable position in accordance with FIG. 2. According to the first embodiment shown in FIGS. 1 and 2 the latch 23 is located in such case in a catch 18, whereby however according to the embodiment of FIG. 3 the latch 23' is kept away from the engaging area of a catch. The use of a pressure spring 26 or a tension spring 26' is no differing feature of both embodiments because both embodiments basically can be provided with a pressure spring or a tension spring. Because a stronger spring is used in an elastically yielding cross-country ski pole in comparison with a ski pole which can be adjusted only to fixed lengths, it is of advantage to form this stronger spring as a tension spring because in such case it is not possible that the spring can bend out and abut against the outer wall generating further friction and operation. If the ski pole is used which can merely be brought into several fixed lengths, spring 26 may be relatively weak because this spring is used only to achieve an automatic movement of the two tube sections 1 and 2 away from each other. Regarding the embodiment according to FIG. 3 it must be mentioned that a practical execution has shown that a tension spring 26' has good results, if the tension spring in its rest position is pretensioned to about 6 pounds. The tension spring 26' may be screwed against the pin 37 which supports spring 26' such that it is possible to change the operative length of the spring therewith. By this changing of the operative length of the spring an accordingly necessary number of windings can be made to be inoperative.

The practical execution of the ski pole has shown that in case the ski pole is designed or intended, respectively, as cross-country ski pole, the particular location and shape of the operating member is extremely decisive because the ski pole must be switched into the one or the other position without any detrimental influence on the skiing, the walking itself and without the need of an excessive force of the cross-country skier. In place of the shown embodiment of the operating member which is a rotatable cam plate 24 a push button could be arranged, which push button may be such, that it can be moved longitudinally and which push button may also be at the rear side of the ski pole handle and be movable laterally relative to the ski pole's longitudinal axis and accordingly would act directly onto the tilting lever 22. A head of this push button will thereby project to a larger or smaller extent above the shell 3 and may be pressed against the force of a spring to a larger or smaller extent into the inner of the ski pole handle. A rectilinear shifting of the push button or pressing pin would allow the same object as is the case when operating cam 30 in accordance with FIG. 3, i.e. as soon as the pressure of the finger is released, the push button will be pressed by mentioned spring again in its rest position in accordance with FIG. 1. In order to have a locked position of this push button such as in FIG. 2, one longitudinal side of this push button is provided with a groove to form a catch which can be brought to engage into a rigid cam by means of a small movement of this push button laterally to its longitudinal extent (i.e. the movement will proceed in the longitudinal direction of the ski pole). The rigid cam can be shaped and arranged such as is the case with pivot 7 or pin 35.

This mentioned push button can be arranged in accordance with a further embodiment in a 90° rotated position such that this now elongated push button extends in the longitudinal center line or at least parallel to the longitudinal center line of the ski pole. In such case this push button would no longer be located at the rear side of the ski pole handle, it would be located at the head end thereof. Between the push button located as described and the tilting lever 22 a not shown mechanical lever would extend to provide an operational connection.

Figure 4:
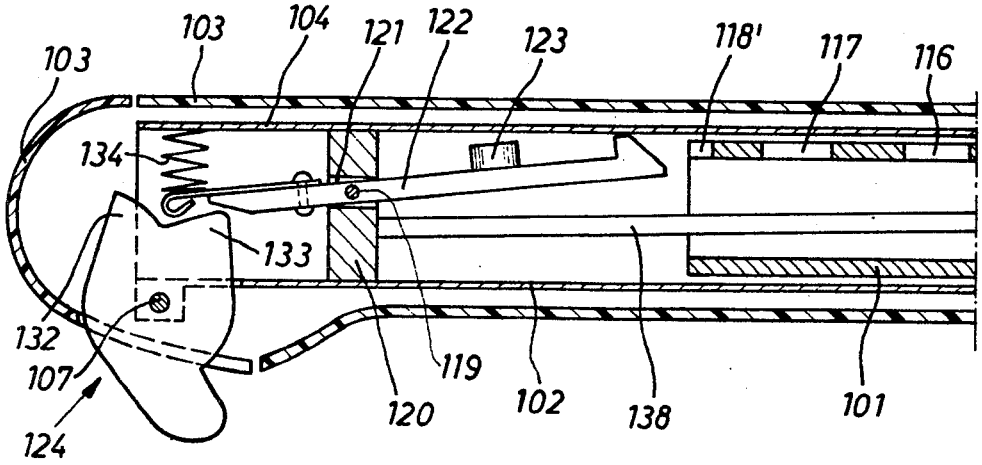
FIG. 4 shows an improved construction at the ski pole, shown schematically, whereby this improved construction may also be arranged in the embodiments of the inventive ski pole shown in FIGS. 1–3 whereby here the operating member is shown in a first operating position.
Figure 5:
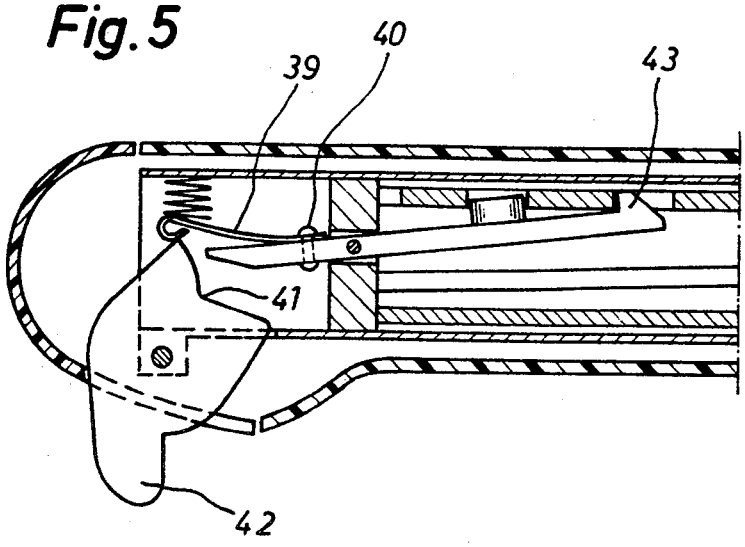
FIG. 5 shows the improved construction of FIG. 4 whereby the operating member is shown in a second position.

In FIGS. 4 and 5 an improvement is shown which may be used in the ski poles shown in FIGS. 1 to 3. In the practice it had been proven that it is of advantage to provide the ski pole with a presetting switching arrangement. This follows in that the cross-country skier can operate the operating member in order to alter the state of the ski pole in any position of the ski pole at will, that, however, it will not be necessary to simultaneously press or push, respectively, the ski pole against the ground. Accordingly, the cross-country skier is in a position to operate the operating member, for instance, during the forward movement of his arm and, however, to initiate the actual switching of the state of the ski pole in the following thrusting of the ski pole against the ground. Accordingly, the rhythmic movement necessary for the cross-country skier will not be detrimentally influenced.

In FIGS. 4 and 5 those structural members which correspond to the structural members shown in FIGS. 1 to 3 are given the same reference numerals to which one hundred is added.

This embodiment of the ski pole comprises an inner tube section 101, i.e. the ski pole proper. Furthermore, an outer tube section 102 is present, which tube section 102 is part of the ski pole handle. A bush 120 having a bearing area 121 for a double armed tilting lever 122 is located in the outer tube section 102. One arm of this tilting lever carries a latch 123. A fitting 104 is located at the outer tube section 102 and a tilting lever spring 134 supports itself at this fitting 104. This tilting lever spring 134 rests with its other end on the other arm of the tilting lever 122. An operating member 124 is pivotable around a bearing or pivot 107 supported in mentioned fitting 104. The operating member 124 is shaped as a cam disk and is provided with cams 132 and 133, which can engage into the tilting lever 122. The inner tube section 101 is provided with three catches 116, 117 and 118'. Furthermore, the ski pole is provided with a handle grip shell 103 made from a plastics material. This above described construction corresponds to the ski pole schematically shown in FIGS. 4 and 5 which corresponds to the structure of the ski pole shown in the embodiment of FIGS. 1 and 3. Following, the differences of the ski pole of FIGS. 4 and 5 in comparison with the ski pole of FIGS. 1 to 3 will be described. The shape of the operating member 124 is different. The operating member 124 comprises only one single cam 42 which is manually operated. Accordingly, there are no further cams corresponding to the two cams 30 and 31 according to FIGS. 1 to 3. In FIGS. 4 and 5 only two different positions of the operating member 124 are shown. In the position of the operating member 124 in accordance with FIG. 4 the tilting lever 122 is located in a recess 41 between the two cams 132 and 133. In accordance with FIG. 5 an action onto the tilting lever 122 proceeds via cam 132. One could now insert a third not shown position of the operating member 124, in which position an action onto the tilting lever 122 would proceed via cam 133. This latter specific operation could be present on a further embodiment of the ski pole; however, a further embodiment is foreseen, in which this theoretical third position of the operating member 24 is not utilized and cannot be enacted due to a built-in obstruction. In the designed embodiment, accordingly, the operating member 124 shall be able to move only into the two shown positions. The ski pole shown in FIGS. 4 and 5 comprises a spring elastic presetting member 39. This presetting member 39 is shaped as a leaf spring. This leaf spring 39 is mounted at 40 to the tilting lever 122. The presetting member 39 is, accordingly, present at the arm of the tilting lever associated with the operating member 124. One can state further, that the presetting member 39 is arranged between the operating member 124 and the latch 123. The tilting lever 122 is continuously urged against the operating member 124 by the tilting member spring 134 and via the presetting member 39. The operating member 124 can be moved into the two fixed positions shown in FIGS. 4 and 5 in accordance with a snapping switch.

The spring biassed presetting member 39 causes that the operating member 124 can be moved into a given position whereby this must not lead to an instantaneous switching of the position of the tilting lever 122. In FIGS. 4 and 5 this tilting lever 122 remains in its position although the operating member 124 is arranged in two various positions. The position of the tilting lever 122 as shown in FIG. 5 will obviously be kept only as long as the inner tube section 101 exerts such a force directed to the right onto latch 123 which overcomes the force stored in spring 39. The above mentioned force which is exerted by the inner tube section 101 onto latch 123 is generated by spring 26 or 26', which spring is shown in FIGS. 1–3. As mentioned, this spring tends to urge the two tube sections 101 and 102 axially away from each other. If the ski pole shown in FIG. 5 is supported against the ground, one acts against this spring force such that the tilting lever 122 will be switched by means of the force exerted by the leaf spring 39 such that the latch 123 will disengage from catch 117. The pole in accordance with FIGS. 4 and 5 is provided with a thrusting rod 138 which acts onto a tensioned spring such as is the case in the embodiment as shown in FIG. 3. If this tension spring is considerably harder than the pressure spring described previously in connection with the embodiments of FIGS. 1 and 2, the ski pole of FIGS. 4 and 5 can be used in two ways. Firstly, it can be used as short pole in which the two tube sections 101 and 102 are completely inserted into each other and whereby latch 123 is located in catch 117, whereby the operating member 124 is in the position as shown in FIG. 4, and secondly, as a spring elastically yielding ski pole whereby the tilting lever 122 extends about parallel to mentioned thrusting rod 138 such that accordingly latch 123 is located outside of the area of engagement of the catch 117 and whereby the operating member 124 is in the position as shown in FIG. 5.

The following description refers now to the switching of the ski pole of the embodiment of FIGS. 4 and 5. In FIG. 4 the operating member 124 is pushed downwards, viewed in the longitudinal direction of the ski pole, which means a sought, short, rigid ski pole. If the ski pole is supported against the ground, the two tube sections 101 and 102 are increasingly pushed into each other. The tilting lever 121 is provided with a ramp 43 arranged in operation ahead of latch 23, which ramp 43 is to cooperate with the inner tube section 101. The face end of the tube section 101 facing this ramp 43 comes into engagement with this ramp 43 such that the tilting lever 122 is rotated clockwise against the force of spring 134 such that the tube section 101 can reach the position shown in FIG. 5. In this position the latch 123 is snapped into catch 117 whereby now the operating member has the position as shown in FIG. 4. Now a short rigid ski pole is provided. If the spring elastically yielding ski pole is chosen, the operating member 124 is pivoted upwards viewed in the longitudinal direction of the ski pole and into a position shown in FIG. 5. Thereby the presetting member 39 is activated because the ski pole itself has not been switched as yet since the strong tension spring maintains latch 123 inside catch 117. Only after the pole according to FIG. 5 has been pushed against the ground, the two tube sections 101 and 102 are relieved via the strong tension spring acting therebetween such that the tilting lever 122 is rotated due to the force of the leaf spring 39 clockwise such that the latch 123 will disengage from catch 117. Now the locking is released and both tube sections 101 and 102 can be moved against each other, against the force of the strong tension spring (such as is the case with tension spring 26' of FIG. 3) and such that now a spring elastically yielding ski pole is arrived at.

Based on FIGS. 4 and 5 a short rigid ski pole and a spring elastically yielding ski pole has now been explained together with the application of a strong spring, preferably a tension spring. When choosing a different arrangement of the catches and of the latch also a long rigid ski pole can be achieved by the same procedure. If a leaf spring is used which is utilized only for the changing of the length of the ski pole, however not utilized for a thrusting aid during the cross-country skiing, a, for instance, short, rigid ski pole, a rigid ski pole having an intermediate length and a long, rigid ski pole can be made. The latch 123 can be arranged at both sides of the tilting lever such that then also the catches of FIGS. 4 and 5 are present at the lower wall of the tube section 101. Due to the ramp 43 the ski pole can be made to have a smaller weight, because by maintaining a same total length of the ski pole the tube sections 101 and 102 can be further moved away from each other in axial direction, i.e. they may themselves be shorter because due to the ramp 43 the tilting lever 122 in the position according to FIG. 4 can be "threaded" into the tube section 101. The tilting lever 122 is rotatable around pivot pin 119.

A further, not specifically shown embodiment could be made such, that the spring elastic presetting member is defined by the tilting lever 122 itself. In such case this tilting lever 122 will be itself a leaf spring. In such case, a specific leaf spring 39 must no longer be present. If the tilting lever 122 is in itself a leaf spring, the one arm of the leaf spring carries latch 123 and the other arm thereof would lie within the area of engagement of the operating member 124.

Practical execution has shown that in case of an embodiment of the ski pole having a strong spring (tension spring) such as explained based on the embodiments in accordance with FIGS. 3–5, whereby accordingly a spring elastically yielding ski pole may be shaped, the following drawback may not appear. If the operation proceeds with such a strong spring which necessitates an exertion of a force in the range of 4–30 pounds in order to bring the spring into its maximal tensioned position in accordance with FIG. 3, this large spring force acts onto the latch and onto the catch in the locked situation of the two tube sections. This large force may now after a certain period of time lead to a nonoperation of the catch which is as mentioned earlier shaped as a through hole in a due to weight reasons as thin as possible tube section 1, 101, respectively. Due to such an operation the through hole acting as catch in this inner tube section the latch 23' or 123, respectively, would slip out of a respective catch, i.e. would disengage from the catch. This unwanted changing of the ski pole must be prevented. For this case it has been proven advantageous to shape the latch and the catch such, that the latch engaging into the catch reaches behind the inner tube section 1, 101, respectively (ski pole proper) for a form closed engagement. This may be attained in a rather simple way if, for instance, the catch 117 shaped in accordance with FIG. 4 as circular hole as a transition into a not shown slot which extends about in the direction of catch 118' and if at the same time the latch 123 is provided with a thickened head portion which accordingly is arranged on the latch 123 at the position facing away from the tilting lever 122. The latch 123 would have in such case a throat section having a decreased diameter and a thickened head section. The thickened head section of latch 123 would move into the catch 117 and by means of the in axial direction proceeding mutual urging away of the two tube sections 101 and 102 from each other by action of mentioned spring the throat section of latch 123 would move into above mentioned slot such that the thickened head section of latch 123 would be located behind this slot. Now, latch 123 can be disengaged from catch 117 only after the inner tube section 101 of FIG. 4 has been moved to the left, i.e. only after the ski pole has been thrusted or supported against the ground and simultaneously the force of mentioned strong tension spring 26' (FIG. 3) has been overcome. Such a structural arrangement of the catch 117 with a slot is known in fittings of wooden beds at which the side boards are mounted to the head board and the foot board thereof.

The practical execution has shown further that if the ski pole is made with a weak spring (for instance pressure spring) in accordance with FIGS. 1, 2, 4 and 5 the position of the operating member 124 at the position in accordance with FIG. 5 is not wanted because in order to achieve this, the cross-country skier would have to make an unnatural movement with his index finger in that he would have to press the operating member 124 upwards. In order to avoid this a further embodiment avoids the position of the operating member shown in FIG. 5 whereby the operating member 124 which has been rotated into the position of FIG. 4 can be rotated into this position only, in which position the cam 133 acts upon the tilting lever 122. This position of the operating member 124 is no rest position; it will arrived at only as long as the finger acts onto the operating member 124 such as is the case at the position of the operating member 24 shown in FIG. 3. In this position of the operating member 124 the cross-country skier desires to alter the length of his ski pole, i.e. he wants to alter the ski pole from a present short state to a long state or from a present long state into a short state of its longitudinal dimension. If a changing from a present short state of longitudinal dimension into a long state thereof is wished, this elongation will be made immediately by spring 26 (FIGS. 1, 2). The cross-country skier must in such case, however, immediately release the operating member 124 which then will return into its rest position shown in FIG. 4 such that the latch 123 can snap into the catch according to the long state of the ski pole. If the ski pole is changed from a present long state of elongation to a shorter length, this shortening of the ski pole proceeds obviously not earlier than when placing the ski pole onto the ground, i.e. when the ski pole is supported against the ground. If in such case the inner and outer tube sections are increasingly telescopically moved into each other against the force of spring 26, the cross-country skier must again release the operating member 124 such that it returns into its position in accordance with FIG. 4 and such that latch 123 can snap into the respective catch. If the cross-country skier forgets to release the operating member 124 at the proper time, the catch 123 will not be released for a snapping into a respective catch and the sought shortening of the length of the ski pole will not be carried out. In order to avoid that this sought shortening of the ski pole will not be carried out, i.e. if the operating member 124 is not timely released if the cam 133 is in operation, the inner tube section 101 can be provided with a not shown nose, which, for instance, is standing somewhat out of the wall of the tube section 101 and which nose will be located between the two catches 116 and 117 within the path of latch 123. If now accordingly latch 123 could not snap into catch 116 because the cross-country skier has not released the operating member 124 in time, the ski pole will move back only somewhat to the longest position, namely so long until latch 123 abuts above mentioned nose. This mentioned nose had accordingly a stop shoulder for latch 123 arranged at the right side according to FIG. 4. During the next following placing of the ski pole, i.e. as soon as the inner tube section 101 is again thrusted against the ground, the inner tube section 101 in accordance with FIG. 4 will be moved to the left such that latch 123 can snap into catch 116.

While there are shown and described present preferred embodiments of the invention, it is to be distinctly understood that the invention is not limited thereto, but may be otherwise variously embodied and practiced within the scope of the following claims. Accordingly,

What is claimed is:

1. A longitudinally adjustable ski pole comprising two tube sections arranged in a telescopic relationship, a handle grip disposed on the outer tube section, latching means including a latch member and a plurality of catches for fixedly latching said tube sections in one or more related and extended positions, an operating member located at said handle grip within a reach of the fingers of the skier's hand gripping said ski pole, a spring member engaging the inner tube section and the outer tube sections for biasing said tube sections away from each other to an extended position, a double arm, spring-biased tilting lever supported in said outer tube section, said latching member arranged at one arm of said tilting lever and the other arm of said tilting lever being engaged by said operating member, said operating member and said tilting lever being shiftable into three different positions to selectively engage and disengage said latching means to enable said tube sections to move to and from said retracted and extended positions with the spring biasing said tilting lever being in a tensioned condition at all of said positions.

2. The ski pole of claim 1, wherein one of said end positions of said operating member is arrestable by said tilting lever, further wherein in this said end position of said operating member said latching means is maintained out of engagement with said catches such that both said tube sections may alternatingly be urged into each other against the force of said spring and be urged from each other by means of the stored elastic force of said spring.

3. The ski pole of claim 1, wherein one of said end positions of said operating member is arrestable by means of said tilting lever, wherein further in this end position of said operating member said latching means is kept arrested in such of said catches which is located closest to said operating member, such that said ski pole is arrestingly held in its longest position.

4. The ski pole of claim 1, wherein at the intermediate position of said operating member said latching means is held in one of said catches by means of said tilting lever spring.

5. A longitudinally adjustable ski pole comprising two tube sections arranged in a telescopic relationship, a handle grip disposed on the outer tube section, latching means arranged at the outer tube sections and including a latch means and a plurality of catches for fixedly latching said tube sections in one or more retracted and extended positions, said catches located in a spaced relation along the axis of the inner tube section and formed by at least one through hole in the wall of said inner tube section and a shoulder located adjacent said inner tube section, an operating member located at said handle grip within reach of the fingers of the skier's hand gripping said ski pole, a spring member engaging said inner tube section and said outer tube section for biasing said tube sections away from each other to an extended position, a double arm, spring-biased tilting lever supported in said outer tube section, said latching member arranged at one arm of said tilting lever said operating member operatively engaging said tilting lever to move said latching member into or out of engagement with said catches to enable said tube sections to move to and from said retracted and extended positions.

6. The ski pole of claim 5, wherein said catches are located at the one side only relative to the longitudinal center axis of said inner tube section.

7. The ski pole of claim 5, wherein at least one catch each is located at both sides of the longitudinal center axis of said inner tube section.

8. A longitudinally adjustable ski pole comprising two tube sections arranged in the telescopic relationship, a handle grip disposed on the outer tube section, latching means including a latch member and a plurality of catches for fixedly latching said tube sections in one or more retracted and extended positions, a spring member engaging the inner tube section and said outer tube section for biasing said tube sections away from each other to an extended position, a double arm, spring-biased tilting lever supported in said outer tube section, said latch member arranged at one arm of said tilting lever, and a rotatable cam disk located at said handle grips, having an axis of rotation extending perpendicularly to the axis of said ski pole and engaging the other arm of said tilting lever, said cam disk comprising at least four cam, two of which alternatingly project outwards beyond an unmovable portion of the ski pole grip and adapted to alternatingly be urged by the skier to and from a position within said ski pole grip to selectively engage and disengage said latching means to enable said tube sections to move to and from said retracted and extended positions.

9. A longitudinally adjustable ski pole comprising two tube sections arranged in a telescopic relationship, a handle grip disposed on the outer tube section, latching means including a latch member and a plurality of catches located in a spaced relation along the longitudinal axis of the inner tube section for fixedly latching said tube sections in one or more retracted and extended positions, a spring member engaging said inner tube section and said outer tube section for biasing said tube sections away from each other to an extended position, a double arm, spring-biased tilting lever supported in said outer tube section, said latching member arranged at one arm of said double arm tilting lever, an operating member located at said handle grip within a reach of the fingers of the skier's hand gripping said ski pole and engaging the other arm of said tilting lever to selectively engage and disengage said latching means to enable said tube sections to move to and from said retracted and extended positions.

10. The ski pole of claim 9 wherein said operating member and said tilting lever are shiftable into two end positions and and intermediate position located between said two end positions, and wherein the spring biasing said tilting lever is in a tensioned condition in all of said positions.

11. The ski pole of claim 10 wherein in one of said end positions said latching member is maintained out of engagement with said catches such that both of said tube sections may alternatingly be urged into each other against the force of said spring member and be urged from each other by means of the stored elastic force of said spring member.

12. The ski pole of claim 10 wherein in one of said end positions said latching member engages in one of said catches which is located closest to said operating member, such that said ski pole is locked in its most extended position.

13. The ski pole of claim 10 wherein at said intermediate position said latching member is hold in one of said catches by means of said tilting lever spring.

14. The ski pole of claim 9, wherein a spring biassed presetting member is located between said operating member and said latching means.

15. The ski pole of claim 14, wherein said presetting member is located at the tilting lever arm associated with said operating member.

16. The ski pole of claim 14 further comprising a leaf spring, one of the arms of which carries said latching means and the other arm of which is located within the area of engagement of said operating member, so that said spring elastic presetting member is formed by the tilting lever itself.

* * * * *